US008196323B2

(12) United States Patent
Waltersdorf

(10) Patent No.: US 8,196,323 B2
(45) Date of Patent: Jun. 12, 2012

(54) WRISTBAND WITH FOLDING LINER

(75) Inventor: Bryan M. Waltersdorf, Oconomowoc, WI (US)

(73) Assignee: Artemax, Inc., Brookfield, WI (US)

( * ) Notice: Subject to any disclaimer, the term of this patent is extended or adjusted under 35 U.S.C. 154(b) by 68 days.

(21) Appl. No.: 12/410,004

(22) Filed: Mar. 24, 2009

(65) Prior Publication Data

US 2010/0242324 A1 Sep. 30, 2010

(51) Int. Cl.
*A44C 5/00* (2006.01)

(52) U.S. Cl. ..... 40/633; 40/630; 40/661.09

(58) Field of Classification Search ..... 40/633, 40/630, 661.06; 428/41.9, 41.7, 41.8
See application file for complete search history.

(56) References Cited

U.S. PATENT DOCUMENTS

| | | | | |
|---|---|---|---|---|
| 3,197,899 | A * | 8/1965 | Twentier | 40/633 |
| 4,078,324 | A * | 3/1978 | Wiebe | 40/665 |
| 4,914,843 | A * | 4/1990 | DeWoskin | 40/633 |
| 5,457,906 | A * | 10/1995 | Mosher, Jr. | 40/633 |
| 5,700,537 | A * | 12/1997 | Instance | 428/41.9 |
| 6,349,493 | B1 * | 2/2002 | Newman et al. | 40/633 |
| 6,546,656 | B2 | 4/2003 | Twentier | |
| 6,782,648 | B1 * | 8/2004 | Mosher, Jr. | 40/633 |
| 6,783,830 | B2 * | 8/2004 | Cohen et al. | 428/40.1 |
| 6,836,215 | B1 * | 12/2004 | Laurash et al. | 340/572.1 |
| 7,240,446 | B2 * | 7/2007 | Bekker | 40/633 |
| 7,316,358 | B2 | 1/2008 | Kotik et al. | |
| 7,320,194 | B2 | 1/2008 | Ali et al. | |
| 7,520,078 | B2 | 4/2009 | Ali et al. | |
| 2007/0028495 | A1 * | 2/2007 | Kotik et al. | 40/633 |

* cited by examiner

*Primary Examiner* — Joanne Silbermann
*Assistant Examiner* — Christopher e Veraa
(74) *Attorney, Agent, or Firm* — Michael Best & Friedrich LLP

(57) ABSTRACT

A wristband assembly comprising a wristband strap, an adhesive positioned on the strap, and a liner assembly. The liner assembly includes a liner having a releasable portion in releasable contact with the adhesive, and an affixed portion secured to the wristband strap (e.g., by a bonding agent spaced from the adhesive). The releasable portion is spaced from the affixed portion. Preferably, the liner assembly further includes a release layer (e.g., comprising silicone) on the releasable portion and not on the affixed portion. In one embodiment, the release layer includes an edge between the releasable portion and the affixed portion, and bonding agent is spaced from the edge. In another embodiment, the liner includes a perforated portion between the affixed portion and the releasable portion (e.g., substantially at an edge between the releasable portion and the affixed portion).

18 Claims, 4 Drawing Sheets

WRISTBAND WITH FOLDING LINER

BACKGROUND

The present invention generally relates to wristbands, and specifically to wristbands having an adhesive for securing the wristband in a loop.

Wristbands are commonly used as a means for identifying an individual. For example, wristbands can be used to identify individuals that are authorized to be in a certain location (e.g., at a concert or a park) or to consume certain food or beverages (e.g., at a party), such as alcoholic beverages. Wristbands are commonly of a certain color or imprinted pattern to facilitate visual identification at a distance.

Some wristbands include an adhesive layer on one end in order to facilitate closing the wristband in a loop around the user's wrist or ankle. During the manufacture of these wristbands, adhesive is applied to one end of the wristband, and a non-adhesive liner is placed over the adhesive in order to prevent the adhesive from sticking to something during shipment to the user. For example, such liners are commonly made from a sheet of material (e.g., paper or plastic) that is coated with a silicone layer that provides temporary adhesion to the adhesive. That is, the silicone layer will lightly adhere to the adhesive, but can be easily peeled from the adhesive layer when the user desires to use the wristband.

Upon removal of the liner, it is desirable to throw the liner into the trash. However, trash receptacles are not always readily available, and thus it is common for the user to either put the liner in a pocket or throw it on the ground, neither of which is desirable.

U.S. Pat. No. 5,457,906 discloses a wristband having adhesive for closing the wristband, and a liner that is permanently affixed to the adhesive. This is beneficial in that it keeps the liner attached to the wristband, which precludes the need to find an appropriate place to dispose of the liner. In use, the liner is peeled away from a portion of the adhesive and then bent backward to lie flat on the inside surface of the wristband.

SUMMARY OF THE INVENTION

The above-described design has been found to be unsatisfactory because the liner does not easily lie flat on the inside surface of the wristband. That is, it tends to bow out, which makes it more difficult to keep in position while the user is closing the wristband.

The present invention provides a wristband assembly comprising a wristband strap, an adhesive positioned on the strap, and a liner assembly. The liner assembly includes a liner having a releasable portion in releasable contact with the adhesive, and an affixed portion secured to the wristband strap (e.g., by a bonding agent spaced from the adhesive). The releasable portion is spaced from the affixed portion. Preferably, the liner assembly further includes a release layer (e.g., comprising silicone) on the releasable portion and not on the affixed portion. In one embodiment, the release layer includes an edge between the releasable portion and the affixed portion, and bonding agent is spaced from the edge. In another embodiment, the liner includes a perforated portion between the affixed portion and the releasable portion (e.g., substantially at an edge between the releasable portion and the affixed portion).

DETAILED DESCRIPTION

Figure 1:
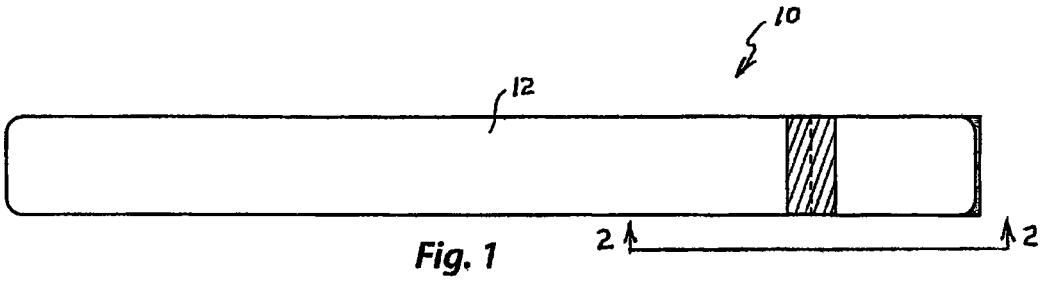
FIG. 1 is a plan view of a wristband assembly embodying one aspect of the present invention.
Figure 2:
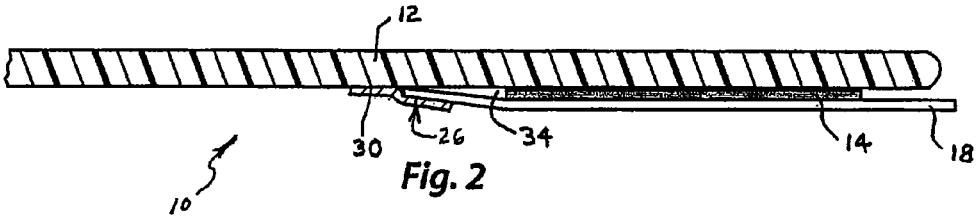
FIG. 2 is a section view taken along line 2-2 in FIG. 1.
Figure 3:
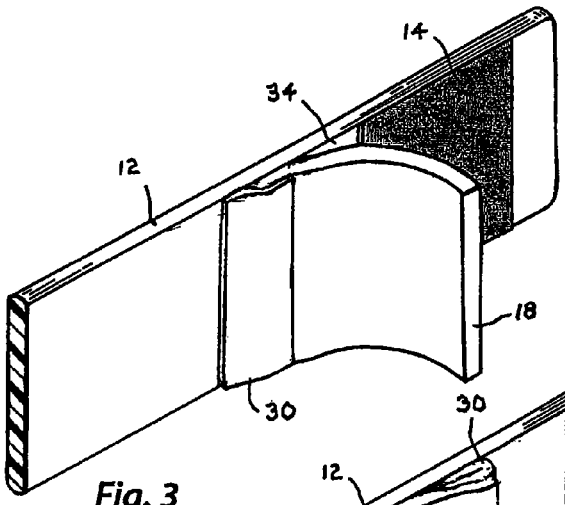
FIG. 3 is a perspective view of a portion of the wristband assembly in FIG. 1 with a release liner partially peeled from adhesive.
Figure 4:
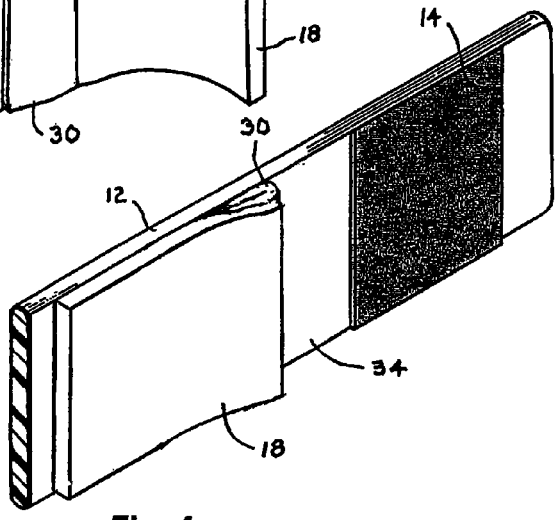
FIG. 4 is the perspective view FIG. 3 with a release liner fully peeled from adhesive and folded back.
Figure 5:
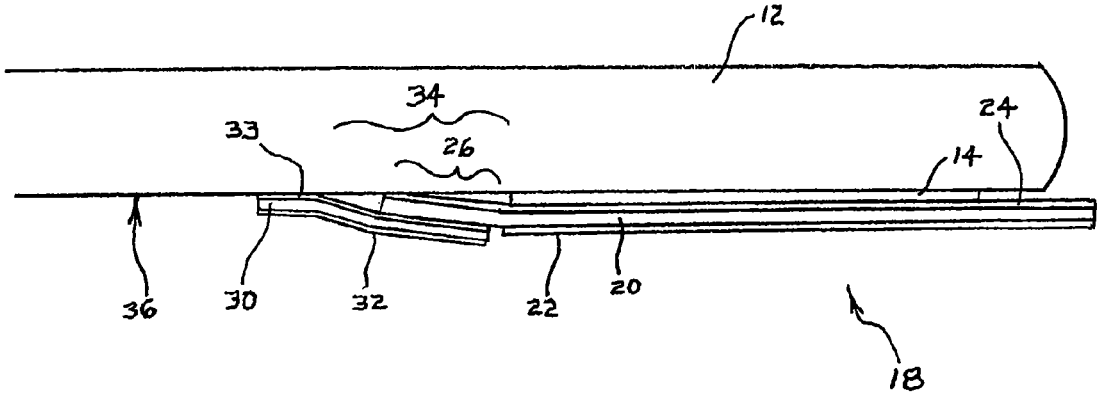
FIG. 5 is an enlarge side view of the wristband assembly of FIG. 1.

FIGS. 1-5 illustrate a wristband assembly 10 including a wristband strap 12, a closure in the form of adhesive 14, and a liner assembly. The strap 12 is designed to wrap around and secure to an item or person (e.g., a person's wrist or ankle), as is known in the art. It can be made from any of a variety of appropriate materials, such as paper, plastic, Tyvek® (a trademark of E.I. DuPont de Nemours), or a composite. Further, the strap 12 can be sized and shaped as desired.

The adhesive 14 is positioned near one end of the strap 12 and provides a mechanism for securing that end of the strap 12 to another portion of the strap 12 in order to form a loop around an object, as is known in the art. The illustrated adhesive covers the full width of the strap and is shaped in a rectangular configuration. The length of the adhesive is slightly longer than the width, and the adhesive and is spaced slightly from the end of the strap 12. The adhesive is about 0.003 inches thick. The adhesive 14 could be any suitable adhesive, such as a modified acrylic composition, a rubber-based adhesive, and the like.

The liner assembly comprises a release liner 18 and a means for securing the release liner 18 to the strap 12. The illustrated release liner 18 includes a 0.003 inch thick base layer 20 made from paper, an external silicone layer 22 pattern coated onto the external surface (i.e., facing away from the strap) of the base layer, and an internal silicone layer 24 covering the entire internal surface (i.e., facing toward the strap) of the base layer. As a result of the above-described configuration, the liner includes a releasable portion in contact with the adhesive, and an affixed portion 26 that generally corresponds with the portion that is not coated with silicone.

The means for securing the release liner 18 to the strap 12 can be a variety of things that secures the liner to the strap 12 in a relatively permanent manner. That is, in a manner that is more secure than the adhesion of the silicone layer to the adhesive 14 described above. In the illustrated embodiment, the means for securing comprises a hinge member made of 0.001 inch thick polyester tape 30. The external surface (i.e., facing away from the strap) of the polyester tape 30 is coated with a silicone layer 32, and the internal surface (i.e., facing the strap) includes a 0.002 inch thick bonding agent 33 (e.g., modified acrylic composition, a rubber-based adhesive, or any other appropriate adhesive). The illustrated polyester tape 30 is positioned so that approximately half of the tape is on the affixed portion 26 of the release liner 18 and the other half of the tape 30 is in contact with the strap 12. In this manner, the polyester tape 30 acts as a hinge for the release liner 18. The thin polyester hinge has been found to fold better than folding the paper release liner. It should be appreciated that, in other embodiments, the hinge member could instead be secured to the strap by stitching, welding, melting, mechanical fastening, co-molding, or any other suitable means.

It is also noted that, when applied to the strap 12, the illustrated tape 30 is spaced from the adhesive 14 to thereby provide a free zone 34 that has no adhesive 14 or tape 30 on the strap. It has been found that the illustrated wristband assembly 10 provides a liner assembly 16 that can easily be peeled away from the adhesive 14 and lie relatively flat against the interior surface 36 of the strap 12, which makes it easier for the user to close the wristband. It is believed that the spacing between the tape 30 and the adhesive 14, combined with the thin polyester hinge member, provides this improved performance.

Figure 6:
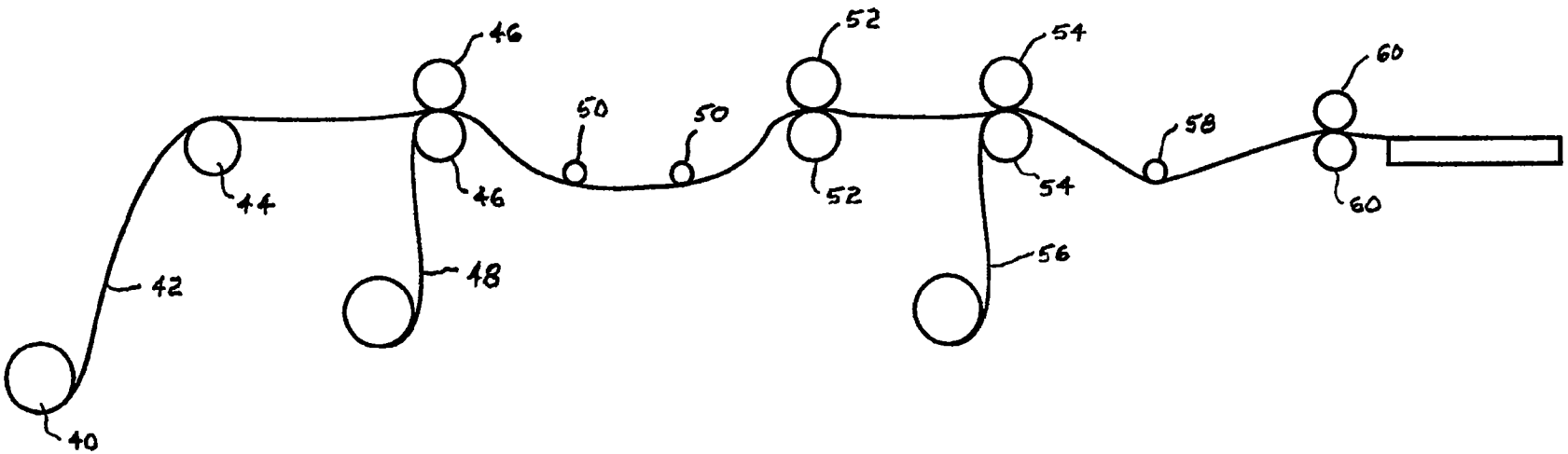
FIG. 6 is a schematic view of a mechanism for creating the wristband assembly of FIG. 1.

The above-described wristband assembly can be manufactured with a machine that is schematically illustrated in FIG. 6. The machine starts with a roll 40 of Tyvek® material that is pulled off in a web 42 and passed over a roller 44. The web 42 is moved into the nip of laminating rolls 46, and a release liner tape 48 having adhesive is brought into contact with the web 42. The web 42 is then passed under two idler rolls and through a destruction die. The web 42 is then moved through the nip of another laminating roll 54, and polyester tape 56 (PET tape) having adhesive in laid over the edge of the release liner tape 48, such that half of the PET tape 56 is over the release liner tape 48 and half is over the web 42. After passing under another idler roller 58, the web 42 passing through a sheet cutter 60, where the web is perforated into distinct but connected wristbands.

Figure 7:
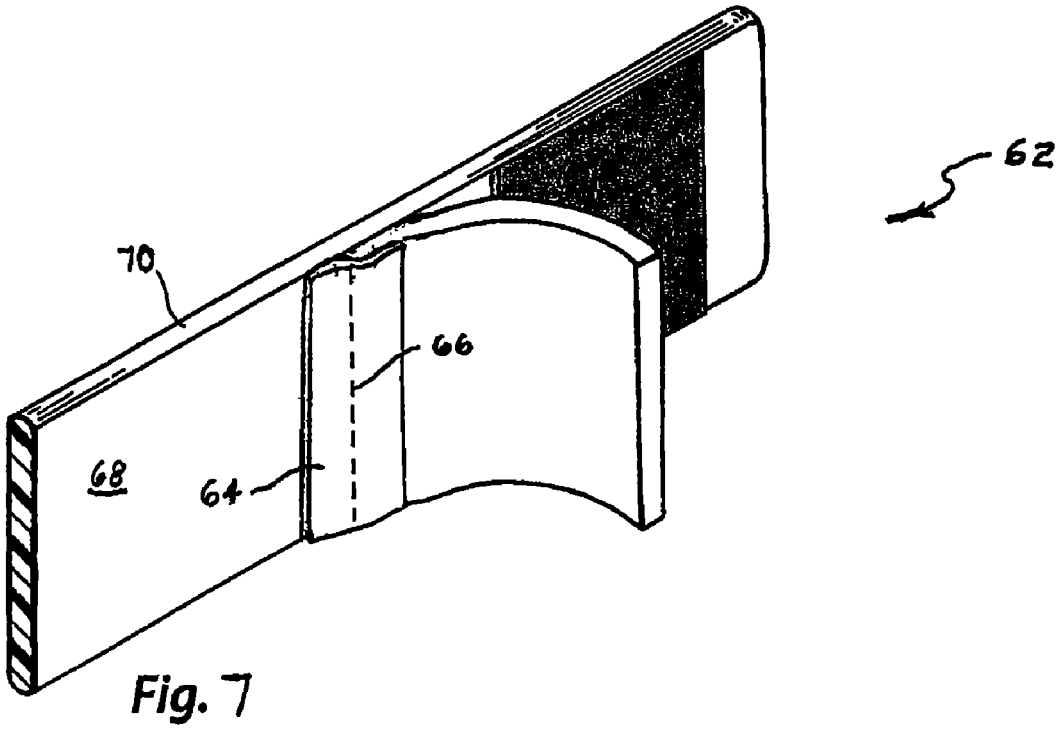
FIG. 7 is a perspective view a wristband assembly embodying another aspect of the present invention.

In the wristband 62 illustrated in FIG. 7, the hinge member 64 is provided with a series of perforations 66. It is believed that these perforations 66 will further improve the ability of the hinge member to fold and lie flat against the interior surface 68 of the strap 70.

It is noted that the drawings in this application are schematic in nature, and are not drawn to scale. In addition, in some drawings, section lines have been removed for clarity.

The invention claimed is:

1. A wristband assembly comprising:
a wristband strap;
an adhesive positioned on the strap; and
a liner assembly including a liner having a releasable portion in releasable contact with the adhesive, an affixed portion secured to the wristband strap, and a hinge portion distinct from and adhesively secured to the affixed portion, wherein the releasable portion is spaced from the affixed portion.

2. A wristband assembly as claimed in claim 1, wherein the liner assembly further includes a release layer on the releasable portion and not on the affixed portion.

3. A wristband assembly as claimed in claim 2, wherein the release layer comprises silicone.

4. A wristband assembly as claimed in claim 1, wherein the affixed portion is secured to the strap by a bonding agent.

5. A wristband assembly as claimed in claim 1, wherein the hinge member acts as a hinge between the liner and the strap.

6. A wristband assembly as claimed in claim 1, wherein the hinge portion comprises polyester.

7. A wristband assembly as claimed in claim 1, wherein the liner includes a perforated portion.

8. A wristband assembly as claimed in claim 7, wherein the perforated portion is between the affixed portion and the releasable portion.

9. A wristband assembly comprising:
a wristband strap;
an adhesive positioned on the strap; and
a liner assembly including:
a liner in releasable contact with the adhesive; and
a hinge member coupled to act as a hinge between the liner and the strap, wherein the hinge member comprises a material different than the liner.

10. A wristband assembly as claimed in claim 9, wherein the liner includes a silicone layer in contact with the adhesive.

11. A wristband assembly as claimed in claim 10, wherein the liner includes an affixed portion secured to the hinge member, the affixed portion being substantially free of silicone.

12. A wristband assembly as claimed in claim 9, wherein the liner includes:
a first surface facing the strap and having a first silicone layer in contact with the adhesive; and
a second surface opposite the first surface and having:
an affixed portion that is substantially free of silicone; and
a second silicone layer on a portion of the second surface separate from the affixed portion.

13. A wristband assembly as claimed in claim 9, wherein the hinge member comprises polyester.

14. A wristband assembly as claimed in claim 9, wherein the hinge member has a thickness that is less than a thickness of the liner.

15. A wristband assembly comprising:
a wristband strap;
an adhesive positioned on the strap; and
a liner assembly including a liner having:
a releasable portion in releasable contact with the adhesive;
an affixed portion secured to the wristband strap; and
a hinge portion distinct from and adhesively secured to the affixed portion.

16. A wristband assembly as claimed in claim 15, wherein the liner assembly further includes a release layer on the releasable portion and not on the affixed portion.

17. A wristband assembly comprising:
a wristband strap;
an adhesive positioned on the strap; and
a liner assembly including a liner having:
a releasable portion in releasable contact with the adhesive;
an affixed portion secured to the wristband strap; and
a hinge portion distinct from and adhesively secured to the affixed portion and including a perforated portion between the releasable portion and the affixed portion.

18. A wristband assembly as claimed in claim 17, wherein the perforated portion acts as a hinge between the release portion and the strap.

* * * * *